United States Patent [19]

Bridges

[11] Patent Number: 4,732,339

[45] Date of Patent: Mar. 22, 1988

[54] APPARATUS FOR WINDING A FILAMENT ONTO A FORMER, HAVING GUIDE STRUCTURE FOR REDUCING FILAMENT BENDING

[75] Inventor: Stuart A. Bridges, Bristol, England

[73] Assignee: Rolls-Royce plc, London, England

[21] Appl. No.: 866,365

[22] Filed: May 23, 1986

[30] Foreign Application Priority Data

Jun. 6, 1985 [GB] United Kingdom ..... 8514336

[51] Int. Cl.[4] ..... B65H 81/02; H01E 41/08

[52] U.S. Cl. ..... 242/4 BE

[58] Field of Search ..... 242/4 R, 4 B, 4 BE; 57/10, 13

[56] References Cited

U.S. PATENT DOCUMENTS

| | | | |
|---|---|---|---|
| 1,603,801 | 10/1926 | Potter | 242/4 C |
| 2,360,960 | 10/1944 | Martindell | 242/45 |
| 2,406,397 | 8/1946 | Parkinson | 242/7.14 |
| 2,433,112 | 12/1947 | Goddard | 242/4 B |
| 3,183,583 | 5/1965 | Ostermann | 57/13 |
| 3,801,102 | 4/1974 | LaBoda | 242/4 BE |
| 4,637,563 | 1/1987 | Arii et al. | 242/4 B |

FOREIGN PATENT DOCUMENTS

| | | | |
|---|---|---|---|
| 382384 | 10/1923 | Fed. Rep. of Germany | 242/4 BE |
| 2001400 | 1/1979 | United Kingdom . | |

*Primary Examiner*—David Werner

*Attorney, Agent, or Firm*—Parkhurst & Oliff

[57] ABSTRACT

An apparatus for winding a filament onto a former includes one or more filament supply bobbins mounted on an annular carrier for rotation about a first axis for receiving a plurality of windings of the filament, and a translation device for moving the former relative to the carrier along a path which passes through the carrier thereby enabling the filament to be wrapped around the former. A pair of pinch rollers positioned at the mid span of each bobbin act to guide the filament onto a loading surface over which the filament passes from the pinch rollers to the former. The loading surface is formed by the radially innermost portion of the carrier and is arcuate in cross section. The apparatus reduces bending of the filament as it is wound onto the former.

4 Claims, 7 Drawing Figures

Fig. A.
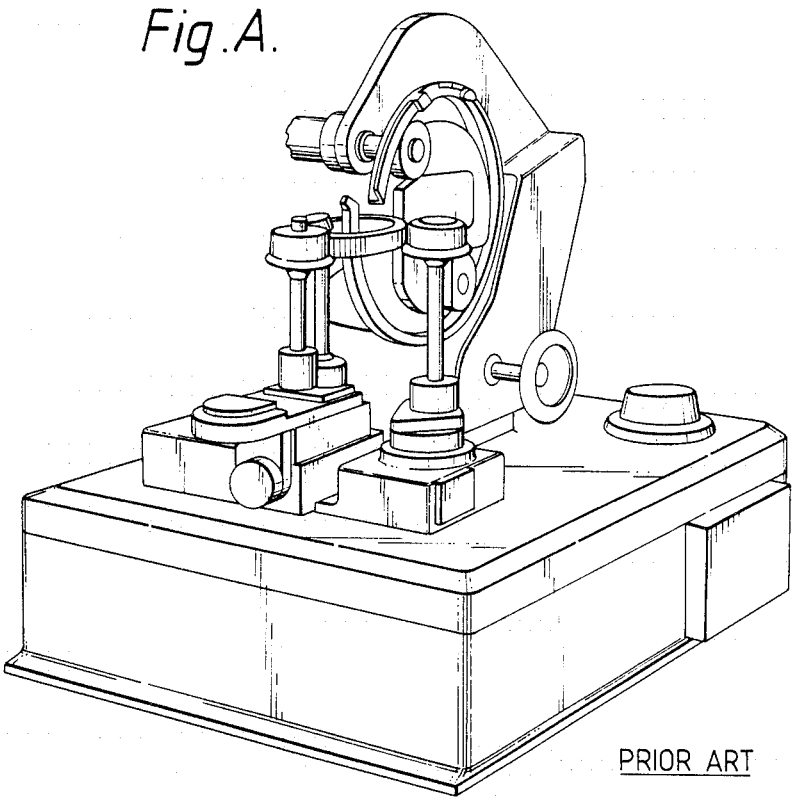
PRIOR ART
Fig. B.
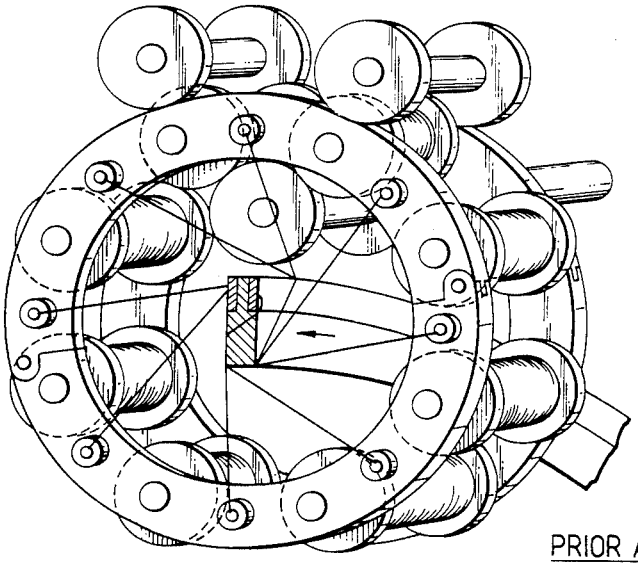
PRIOR ART

APPARATUS FOR WINDING A FILAMENT ONTO A FORMER, HAVING GUIDE STRUCTURE FOR REDUCING FILAMENT BENDING

BACKGROUND OF THE INVENTION

The present invention relates to an apparatus for winding a filament onto a former.

In our UK Pat. No. 2,001,400, there is described an apparatus (shown in FIG. A) suitable for the production of brush seals in which an annular mandrel is mounted for rotation in rollers and carries a pair of annular side plates on its side faces adjacent its radially outer periphery. The mandrel is arranged to pass through an annular filament carrier which is channel-shaped and on which is wound a continuous filament of metallic bristle material. The filament carrier is supported for rotation in a plurality of rollers, one of which is connected to a drive shaft for rotating the carrier, and a similar driving arrangement is used for driving the rollers which support the mandrel. Rotation of the mandrel and the filament carrier causes bristle material to be continuously supplied from the filament carrier, via a slider which tensions the filaments, and wound onto the mandrel to overlie the outer side surfaces of the side plates.

This apparatus, whilst producing adequate seals, suffers from a number of disadvantages due to its design. Several filaments of brush material are bunched together on the carrier, resulting in uneven tension, overlaps, and wire breakages. The slider tends to stick and slip during operation which causes uneven tension and breakages. The erratic movement of the slider also results in a lack of angle control. The filaments are passed through tight radii during winding which makes subsequent heat treatment essential to remove any tendency for the filaments to curl up in the finished brush.

The above mentioned patent also describes an alternative winding mechanism which uses multiple filaments for speeding up the winding process (shown in FIG. B). In this embodiment, eight spools of filament material are mounted upon the carrier and each spool feeds a filament of brush material onto the mandrel. The filaments from the spools are passed through holes in one side of the side plates of the spool carrier to ensure that they always emerge in the same plane to avoid variation in the winding angle as the spools unwind.

The spool carrier is hinged at one position and provided with a latch to enable the annular mandrel to pass through the inside thereof.

The alternative winding mechanism overcomes a number of the problems associated with the first described apparatus. However, some problems remain and others are introduced. The filaments are still passed through tight radii which results in subsequent heat treatment being required and/or wire breakages occurring. Further to this, the carrier is considerably more complex and difficult to load with bobbins of filament material.

SUMMARY OF THE INVENTION

An object of the present invention is to provide an apparatus for the production of brushes which reduces, and possibly eliminates, the above mentioned disadvantages.

Accordingly, the present invention provides an apparatus for winding a filament onto a former, the apparatus comprising one or more filament supply means mounted on an annular carrier for rotation about a first axis, and translation means for moving the former relative to the carrier along a path which passes through the carrier, thereby enabling a filament to be wrapped around the former, the one or more filament supply means comprising a rotatable bobbin for receiving a plurality of windings of a length of the filament, and a first guide member which guides said filament from said bobbin to a second guide member which guides said filament to said former.

BRIEF DESCRIPTION OF THE DRAWINGS

The present invention will now be more particularly described, by way of example only, with reference to the following drawings, in which.

FIGS. A and B illustrate the prior art.

DESCRIPTION OF THE PREFERRED EMBODIMENTS

Figure 1:
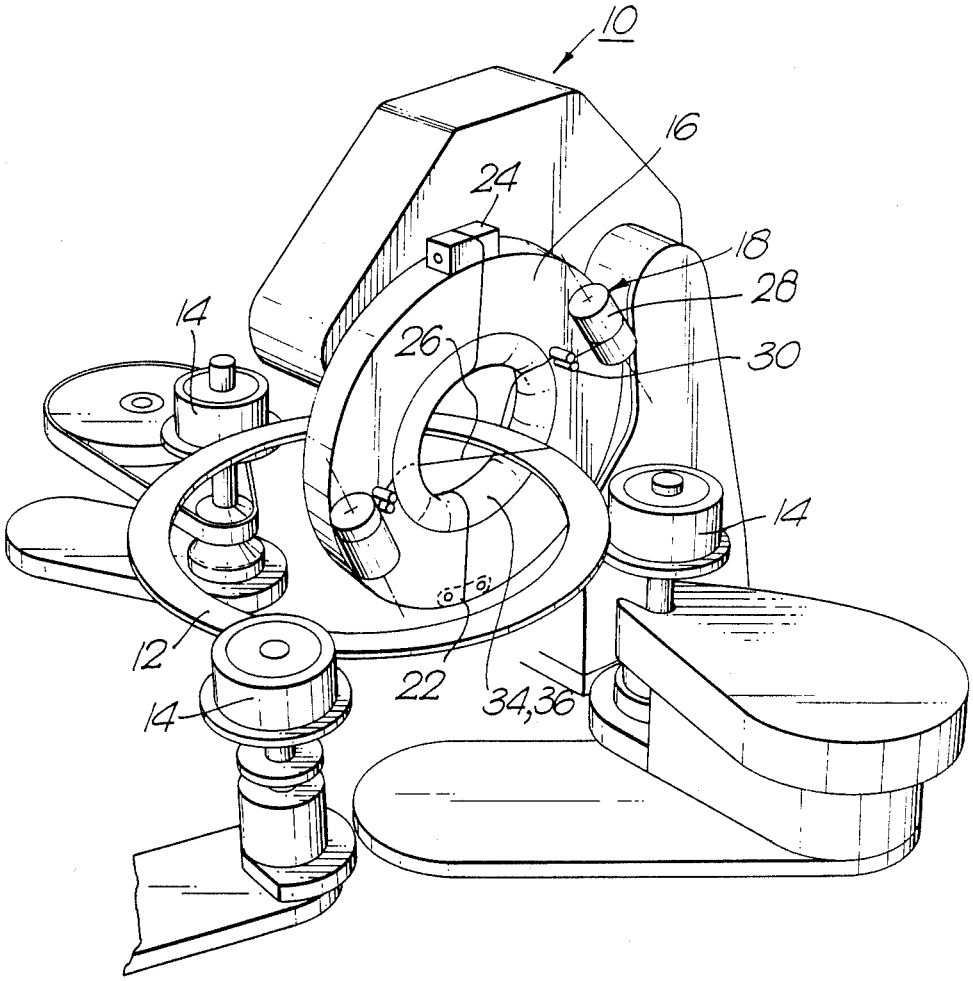
FIG. 1 is a general view of a toroidal winding machine featuring the present invention in a simplified form.

Referring now to FIG. 1, there is shown a conventional toroidal winding machine (10) which incorporates the present invention. An annular mandrel or former (12) is mounted for rotation in driven rollers (15) and carries a pair of annular side plates (not shown) on its side faces adjacent its radially outer periphery. The mandrel (12) is arranged to pass through an annular filament carrier (16) upon which is mounted one or more filament supplying means (18), best seen in FIGS. 2 and 3 The filament carrier (16) is mounted for rotation in a plurality of rollers (not shown), one or more of which are driven. A hinge (22) and latch (24) are provided in the carrier (16) to enable the annular mandrel (12) to pass through the inside thereof.

Rotation of the mandrel (12) and the filament carrier (16) causes a filament of material (26) to be continuously supplied from the supply means (18) and wound onto the mandrel (12) to overlie the outer surface thereof.

Figure 3:
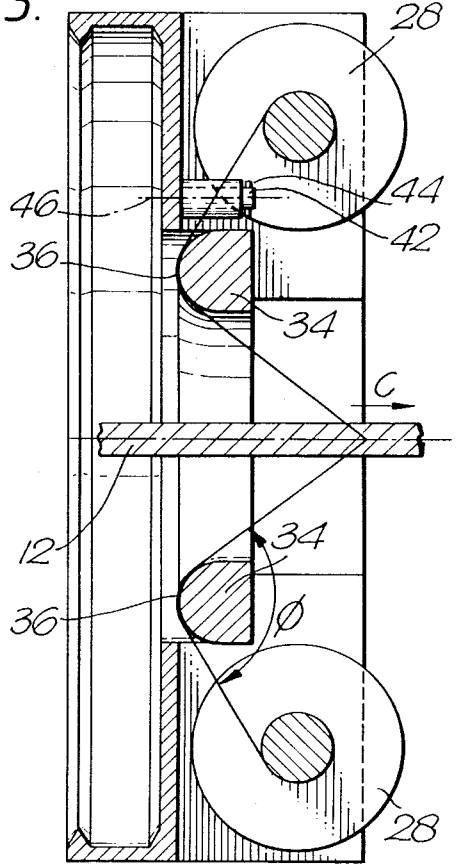
FIG. 3 is a cross sectional view of the present invention in the direction of arrows III—III in FIG. 2.
Figure 2:
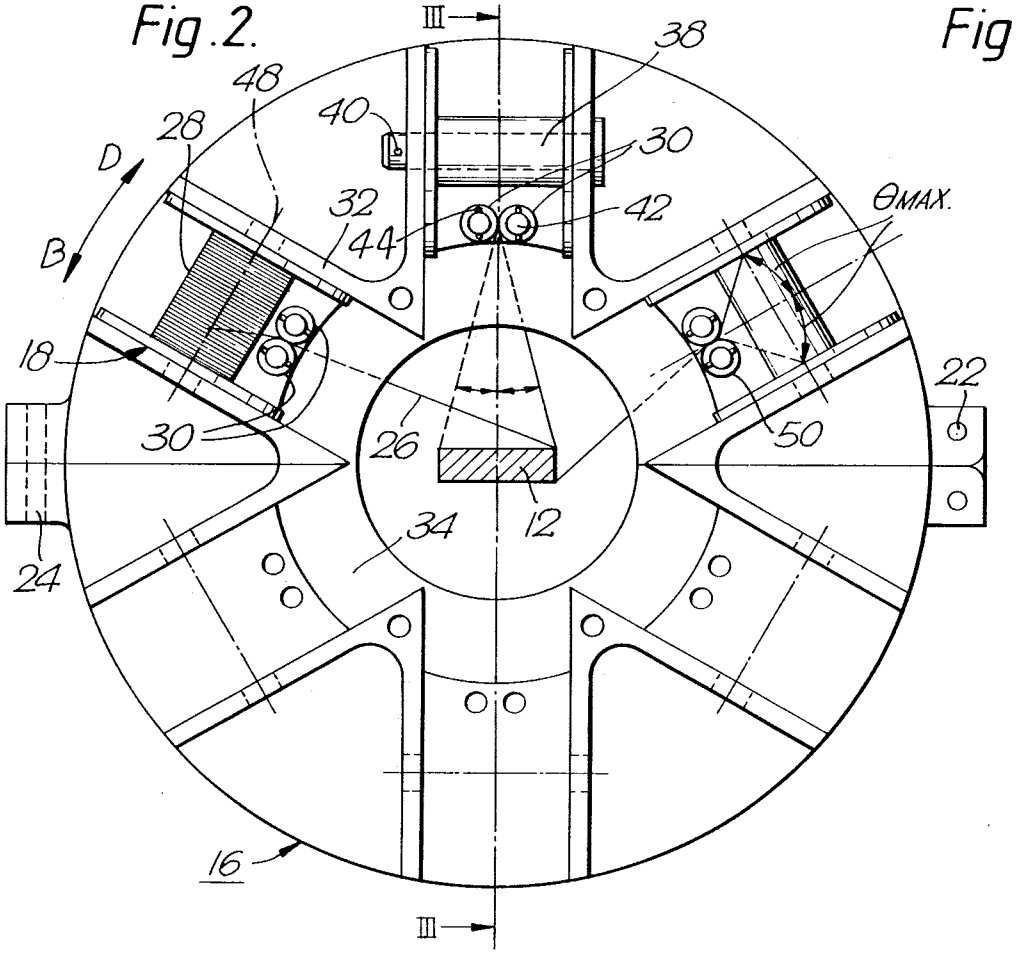
FIG. 2 illustrates the present invention in more detail than that shown in FIG. 1.

Turning now to FIGS. 2 and 3, six filament supply means (18) are shown circumferentially spaced around the carrier (16). Each supply means comprises a bobbin (28), upon which is wound a supply of filament material (26), a pair of pinch rollers (30) through which the filament passes, a support means (32) upon which both the bobbin (28) and pinch rollers (30) are mounted for rotation, and an annular supply ring (34) which is formed by the radially innermost diameter of the carrier (16) and which is provided with an arcuate loading surface (36). The bobbin (28) may be located in the support means (32) by a spindle (38) and split pin (40) arrangement as shown in FIG. 2 or by any other conventional means. The pinch rollers (30) are each mounted on spindles (42) which form part of said support means (32) and are retained thereupon by a circlip (44) or any other conventional retaining means. The axis of rotation of the pinch rollers (46) is arranged to be substantially orthogonal to, but spaced apart from, the axis of rotation of the bobbin (48).

Preferably, the bobbin (28) is a light interference fit on the spindle (38) such that rotation of the bobbin (28)

is at least partially resisted, and the filament material (26) is tensioned as it is supplied to the mandrel (12).

The support means (32) may form an integral part of the carrier (16) as shown in FIGS. 2 and 3, or it may be a separate part and joined thereto by any conventional means. The pinch rollers (30) may be provided with some form of resilient coating (50), such as rubber, around their circumference which acts to locate the filament material (26) securely between said rollers (30).

In operation, a strand of filament material (26) is taken from the bobbin (28) and passed through the pinch rollers (30) before being taken over the loading surface (36) (through an angle of lap $\phi$) and supplied to the mandrel (12). As the filament material (26) unwinds from the bobbin (28), it runs from one end of the bobbin (18) to the other such that the feed angle $\theta$ changes from $\theta$ max to zero as shown in FIG. 2. It will be appreciated that $\theta$ max may be minimized by locating the pinch rollers (30) at the mid span of the bobbin (28). As the diameter of the filament material (26) wound on the bobbin (28) reduces, the angle of lap $\phi$ of the filament material (26) as it passes over the loading surface (36) increases, as shown in FIG. 3.

Figure 4:
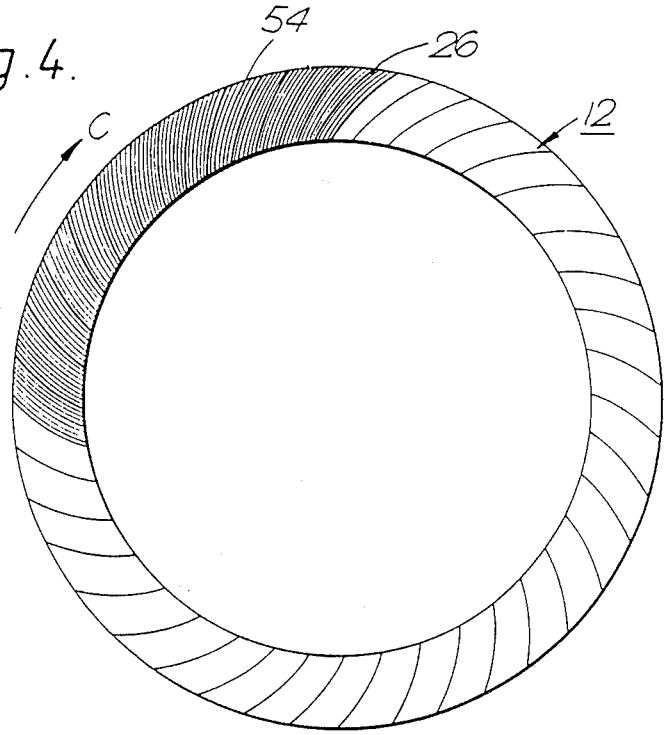
FIGS. 4 and 5 illustrate a left and a right handed winding respectively.
Figure 5:
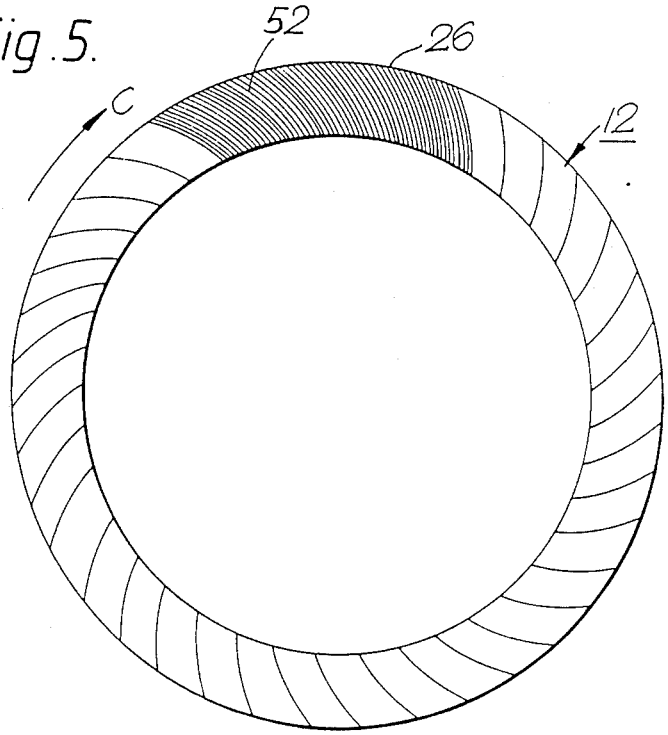

A major advantage of this apparatus is that it is capable of producing both left and right handed windings (52,54) as shown in FIGS. 4 and 5. This is simply achieved by changing the direction of rotation of the carrier (16). A right handed winding (52) may, for example, be produced by rotating the carrier (16) in the direction of arrow B (FIG. 2) whilst the mandrel (12) is rotated in the direction of arrow C (FIG. 3). Rotation of the carrier (16) in the direction of arrow D (FIG. 2) whilst the mandrel (12) is rotated in the same direction as above will produce a lefthanded winding (54).

An example of a filament material (26) which may be used in the production of brushes which are intended to act as seals in high temperature applications is a Nickel alloy sold under the tradename of HAYNES 25. It has been found that for a filament (26) having a diameter of 0.07 mm (0.0028") the angle at which the filament leaves the bobbin, $\theta$, may be as much as 44° and the radius of curvature of the loading surface (36) as little as 6 mm, without the filament material (26) requiring subsequent heat treatment to remove any tendency to curl up in the finished seal. It will be appreciated, however, that these angles and radii will vary with the properties of the filament material.

I claim:

1. An apparatus for winding a filament onto a former, the apparatus comprising:

an annular carrier rotatable about a first axis of rotation;

filament supply means comprising at least one rotatable bobbin for receiving a plurality of windings of a length of the filament and being mounted on the annular carrier for rotation therewith about said first axis of rotation, said at least one bobbin being further rotatable about a second axis of rotation which is tangential to the first axis of rotation of the carrier;

translation means for moving the former relative to the carrier along a path which passes through the carrier; and first and second filament guide members, said first guide member acting to guide the filament from said at least one bobbin to the second guide member, and said second guide member acting to guide the filament to the former, said first guide member comprising a pair of pinch rollers between which the filament passes and said second guide member comprising an annular ring having an arcuate surface over which the filament passes.

2. An apparatus according to claim 1 in which the annular ring is formed by the radially innermost diameter of the carrier.

3. An apparatus according to claim 1 in which the pinch rollers are positioned at a mid span of said at least one bobbin.

4. An apparatus according to claim 1 in which each pinch roller is provided with a resilient coating around its outer circumference.

* * * * *